US008523149B1

(12) United States Patent
Novak

(10) Patent No.: US 8,523,149 B1
(45) Date of Patent: Sep. 3, 2013

(54) MAGNETIC PANELS AND LOCKING CLIPS

(76) Inventor: Daryl Novak, Cocoa, FL (US)

( * ) Notice: Subject to any disclaimer, the term of this patent is extended or adjusted under 35 U.S.C. 154(b) by 0 days.

(21) Appl. No.: 13/300,011

(22) Filed: Nov. 18, 2011

(51) Int. Cl.
*E04H 17/00* (2006.01)

(52) U.S. Cl.
USPC ..... 256/23

(58) Field of Classification Search
USPC ..... 256/23–25; 24/292–295, 297, 581.11; 160/327, 328, 354, 368.1, DIG. 16
See application file for complete search history.

(56) References Cited

U.S. PATENT DOCUMENTS

| | | | | | |
|---|---|---|---|---|---|
| 3,251,399 | A | | 5/1966 | Grossman | |
| 3,679,505 | A | | 7/1972 | Hinderaker | |
| 4,069,641 | A | * | 1/1978 | DeZutter | 52/202 |
| 4,351,137 | A | * | 9/1982 | Enyart et al. | 52/202 |
| 4,387,541 | A | | 6/1983 | Boomershine | |
| 4,409,758 | A | * | 10/1983 | Dickerson et al. | 49/463 |
| 4,510,986 | A | * | 4/1985 | Schwankl | 160/354 |
| 4,561,223 | A | * | 12/1985 | Gold et al. | 52/202 |
| 4,852,194 | A | * | 8/1989 | Langan | 5/427 |
| 4,911,964 | A | | 3/1990 | Corbo | |
| 5,076,545 | A | * | 12/1991 | Bodzin | 256/1 |
| 5,368,085 | A | | 11/1994 | Ruparelia | |
| 5,533,715 | A | * | 7/1996 | Dandrea | 256/45 |
| 5,642,557 | A | * | 7/1997 | Clews | 24/339 |
| 5,762,393 | A | | 6/1998 | Darmas | |
| 5,772,185 | A | * | 6/1998 | Pulsipher | 256/59 |
| 6,141,921 | A | | 11/2000 | Leeuwenburgh | |
| 6,425,676 | B1 | | 7/2002 | Lyons | |
| 6,513,566 | B2 | * | 2/2003 | Larin | 160/351 |
| 6,712,340 | B1 | * | 3/2004 | Clarmont | 256/19 |
| 6,865,850 | B1 | | 3/2005 | Campbell | |
| D526,743 | S | * | 8/2006 | Battista et al. | D27/161 |
| 7,240,637 | B2 | * | 7/2007 | Rosen | 119/524 |
| 7,497,057 | B1 | | 3/2009 | Hansen | |
| 7,610,727 | B2 | * | 11/2009 | Toledo | 52/222 |
| 2001/0055666 | A1 | * | 12/2001 | Lee et al. | 428/156 |
| 2006/0060831 | A1 | * | 3/2006 | Seas | 256/24 |
| 2007/0138456 | A1 | * | 6/2007 | Clark | 256/24 |
| 2007/0181272 | A1 | * | 8/2007 | Lewis | 160/368.1 |
| 2011/0017965 | A1 | | 1/2011 | Kowalewicz | |

OTHER PUBLICATIONS

Kid Shield Indoor Banister Guard, online, retrieved on Nov. 9, 2011, retrieved from http://www.shop.com/Kid_Shield_Indoor_Banister_Guare%2C_Clear . . . .

Clear Banister Guard Kid for Kids Safety, online, retrieved on Nov. 9, 2011, retrieved from http://www.onestepahead.com/catalog/product.jsp?priductId=131755 . . . .

* cited by examiner

*Primary Examiner* — Joshua Kennedy
(74) *Attorney, Agent, or Firm* — Brian S. Steinberger; Law Offices of Brian S. Steinberger, P.A.

(57) ABSTRACT

Devices, systems and methods of mounting plastic translucent panels and/or colored panels and/or advertising panels to balconies, banisters and stair railings using magnetic fasteners and clips, to protect pets and small children. The panels can be attached by a plurality of strips of double sided magnetic tape to the posts of the banister. Snapable clips can be attached to the posts above and below the panel to further hold the panel to the banister.

15 Claims, 22 Drawing Sheets

MAGNETIC PANELS AND LOCKING CLIPS

FIELD OF INVENTION

This invention relates to pet and child protection, in particular to devices, systems and methods of mounting plastic translucent and/or advertising panels to balconies, banisters and stair railings and across openings between posts using magnetic fasteners and clips, to protect pets and small children.

BACKGROUND AND PRIOR ART

Balconies on condominium and apartment buildings often having railings with spaced apart posts that are generally spaced apart from one another by approximately 6 to approximately 8 inches. While the spacing may be narrow enough to prevent large children from passing through, the spacing is large enough to allow for small children and pets to pass through. In high rises, it has been known that pets, such as cats and dogs have fallen through the spacing, which can result in the pet falling a large distance to ground level below. Similarly, this problem also exists with banisters and stairwells having open post supported railings.

Various attempts have been made over the years to cover the spacing between the support posts. Kidshield Indoor Banister Guard and Clear Banister Guard Kit are two products on the market which generally include translucent plastic panels for covering banister openings. However, both products are not easy to install and remove.

Both products require the installer having to hole punch the plastic sheets in order to and use screw type fasteners and cable ties to fasten the sheets to walls and posts. In addition to causing permanent damage to underlying surfaces, the screws must be each manually attached which can be tedious and time consuming. And both the screws and cable ties are an unsightly when looking at the covered banisters. Furthermore, punching holes in the plastic panels will weaken the panels, and can result in the panels tearing and ripping apart.

Thus, the need exists for solutions to the above problems with the prior art.

SUMMARY OF THE INVENTION

A primary objective of the present invention is to provide devices, systems and methods of mounting plastic translucent and/or advertising panels to balconies, banisters and stair railings using magnetic fasteners and clips, to protect pets and small children.

A secondary objective of the present invention is to provide devices, systems and methods of mounting plastic translucent and/or advertising panels to balconies, banisters and stair railings, without using screws.

A third objective of the present invention is to provide devices, systems and methods of mounting plastic translucent and/or advertising panels to balconies, banisters and stair railings, without causing damage to underlying surfaces.

A fourth objective of the present invention is to provide devices, systems and methods of mounting plastic translucent and/or advertising panels to balconies, banisters and stair railings, without using cable ties.

A fifth objective of the present invention is to provide devices, systems and methods of mounting plastic translucent and/or advertising panels to balconies, banisters and stair railings, without having to punch holes in the panels.

A sixth objective of the present invention is to provide devices, systems and methods of mounting plastic translucent and/or advertising panels to balconies, banisters and stair railings, that is easy to both install and remove.

A seventh objective of the present invention is to provide devices, systems and methods of mounting plastic translucent and/or advertising panels to balconies, banisters and stair railings, that is aesthetically pleasing when installed without using unsightly mounting fasteners.

A barrier system for banisters, balconies and stair railings, includes a flexible panel having a generally rectangular configuration, a plurality of elongated strips with exterior surfaces having adhesive thereon, and a plurality of post clips, wherein the panel is attachable to posts that support railings on the banisters, balconies and stair railings, by positioning the elongated strips between portions of the panel and side surface portions of the post, and by clamping upper and lower edge portions of the panel to side portions of the posts by the post clips.

Each of the elongated strips can include a pair of strips sandwiched together having exterior surfaces with peel and stick tape, and interior facing magnetic surfaces;

Each of the post clips can include a clamp member having a configuration along a horizontal plane for clamping about the side portions of the posts, and a finger portion which extends perpendicular from a horizontal plane of the clamp member so that the finger portion presses against an exterior surface portion of the panel. The finger portion of the clips can include an S shape. Additionally, the finger portion can have a flat exterior face and an inner convex face.

The clamp member of each post clip can include two bendable flanges having outer ends which snap about the side portions of the post. The bendable flanges can have a spacing therebetween of approximately 0.8 inches. The bendable flanges can have a spacing therebetween of approximately 2 inches. Each of the bendable flanges can have snapable hook ends.

The clamp member can be a zip tie. The clamp member can include double sided tape. The clamp member can include a strip having hook and loop fasteners. The clamp member can include a rail clip strap with retaining strap on one end and a second end with a strap clip snap cutout. The clamp member can include a belt with buckle end for clamping about a perimeter surface of the post.

Each clamp member can include a pair of clamp members, and the finger is an elongated member having ends attached to each clamp member. Each of the clamp member pairs can include a rail clip strap with retaining strap on one end and a second end with a strap clip snap cutout.

The plastic panel can include a translucent plastic panel or colored panel with or without signage and indicia thereon.

A barrier system for banisters, balconies and stair railings, can include a flexible panel having a generally rectangular configuration, a plurality of elongated strips with exterior surfaces having adhesive thereon, each of the elongated strips includes a pair of strips sandwiched together having exterior surfaces with peel and stick tape, and interior facing magnetic surfaces, and a plurality of post clips, each of the post clips include a clamp member having a configuration along a horizontal plane for clamping about the side portions of the post and a finger portion which extends perpendicular from a horizontal plane of the clamp member, wherein the panel is attachable to posts that support railings on the banisters, balconies and stair railings, by positioning the elongated strips between portions of the panel and side surface portions of the post, and by clamping upper and lower edge portions of the panel to side portions of the posts by the post clips so that the finger portion presses against an exterior surface of the panel.

A method of protecting banisters, balconies and stair railings, can include the steps of providing a rectangular flexible plastic panel, providing a plurality of double sided tape strips, providing a plurality of attachable and detachable post clamps, attaching one side surface of the panel to surfaces of posts that support railings with the double sided tape strips, and clamping upper and lower edges of the panel to the posts by the post clamps.

The step of providing the plurality of double sided tape strips can include the step of providing each of the elongated strips with a pair of strips sandwiched together having exterior surfaces with peel and stick tape, and interior facing magnetic surfaces.

The step of providing the plurality of post clamps, can include the steps of providing a clamp member having a configuration along a horizontal plane for clamping about the side portions of the post and a finger portion which extends perpendicular from a horizontal plane of the clamp member, and pressing an outer surface portion of the panel with the finger portion.

Further objects and advantages of this invention will be apparent from the following detailed description of the presently preferred embodiments which are illustrated schematically in the accompanying drawings.

BRIEF DESCRIPTION OF THE FIGURES

FIG. 20 is an exploded view of a rail clip being installed to a banister with a tie-on.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A list of the components used with the invention will now be described.

Figure 1:
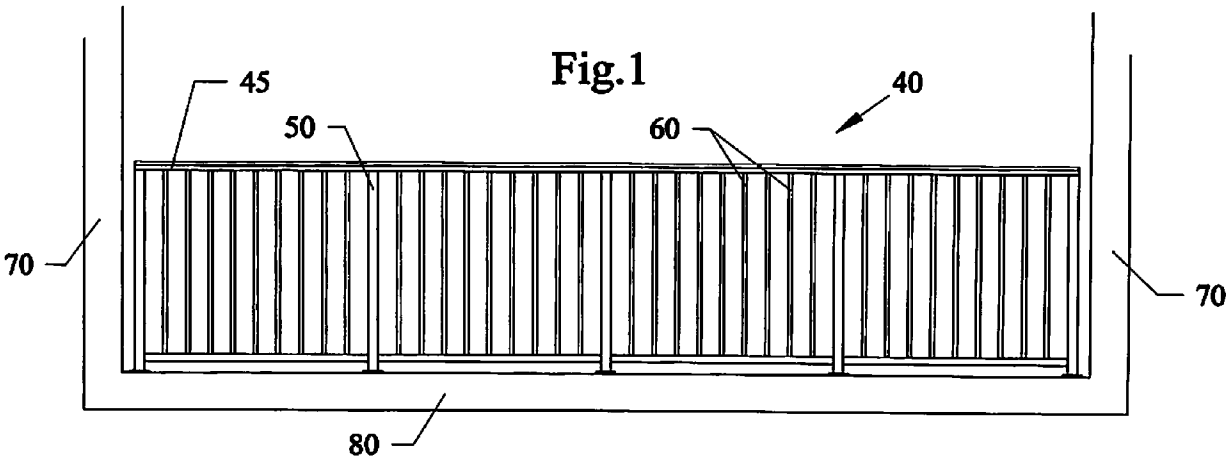
FIG. 1 is a front view of an existing banister with post supported railing.
Figure 2:
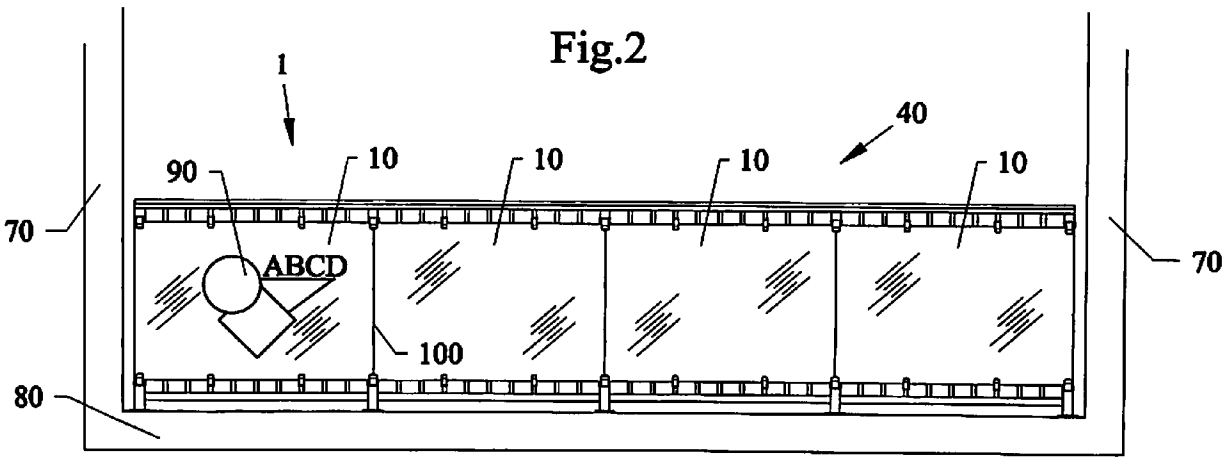
FIG. 2 is a front view of the banister of FIG. 11 with the novel barrier system installed.
Figure 3:
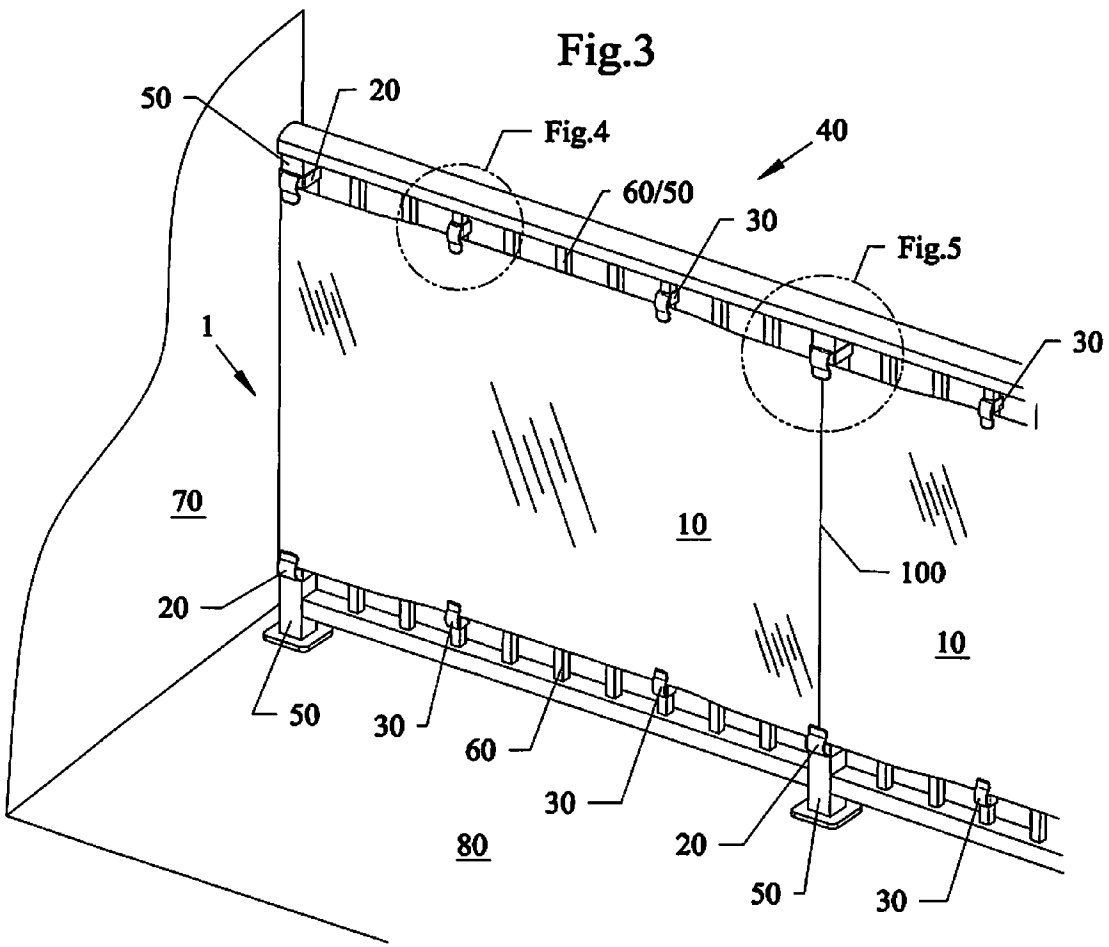
FIG. 3 is an enlarged perspective partial view of the installed barrier system of FIG. 2.
Figure 5:
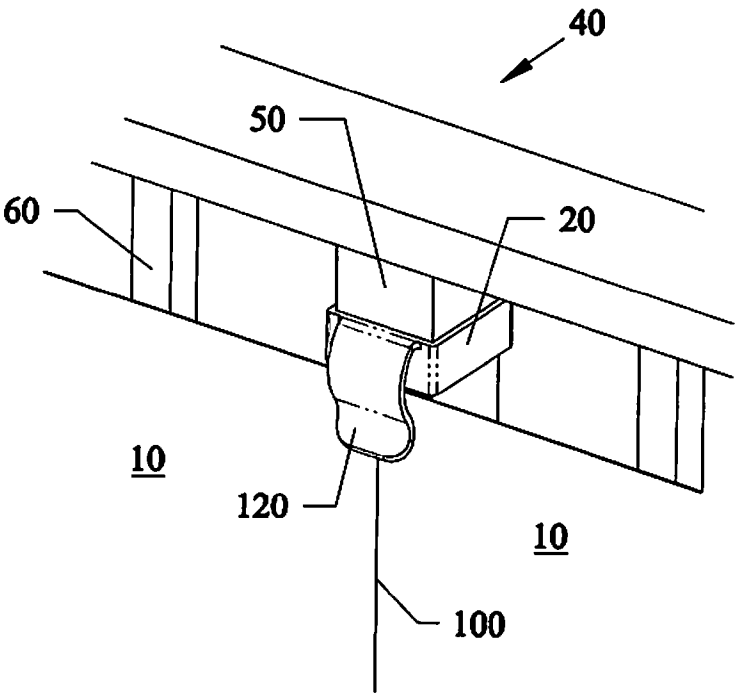
FIG. 5 is an enlarged perspective view of a 2" rail clip for the installed barrier of FIG. 2.
Figure 4:
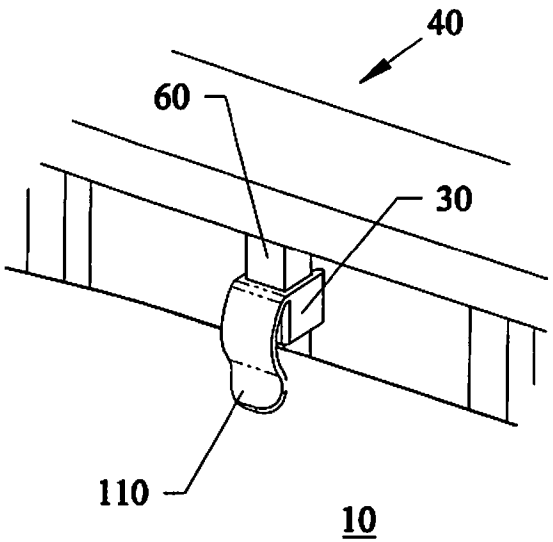
FIG. 4 is an enlarged perspective view of an 0.8" rail clip for the installed barrier of FIG. 2.
Figure 6:
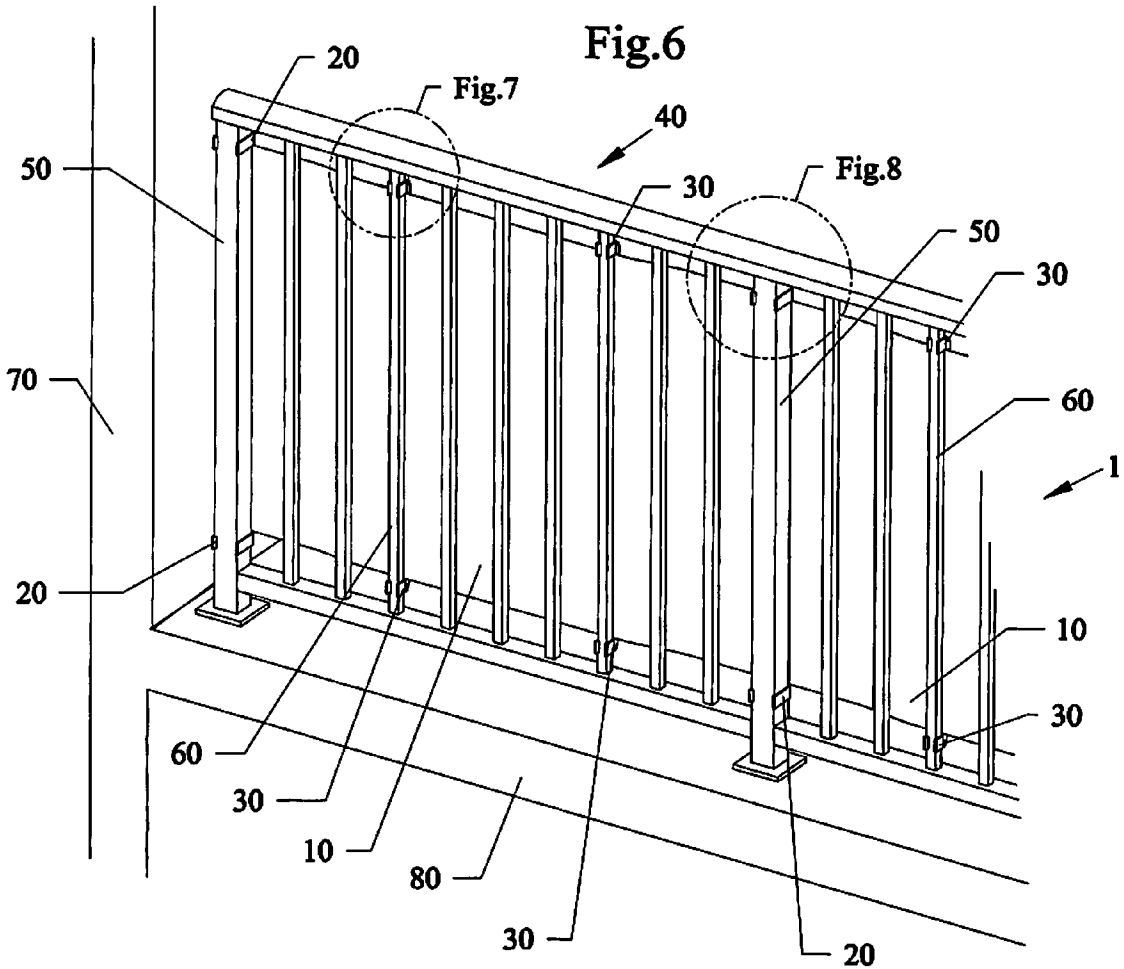
FIG. 6 is a rear perspective view of the installed barrier system of FIG. 3.
Figure 8:
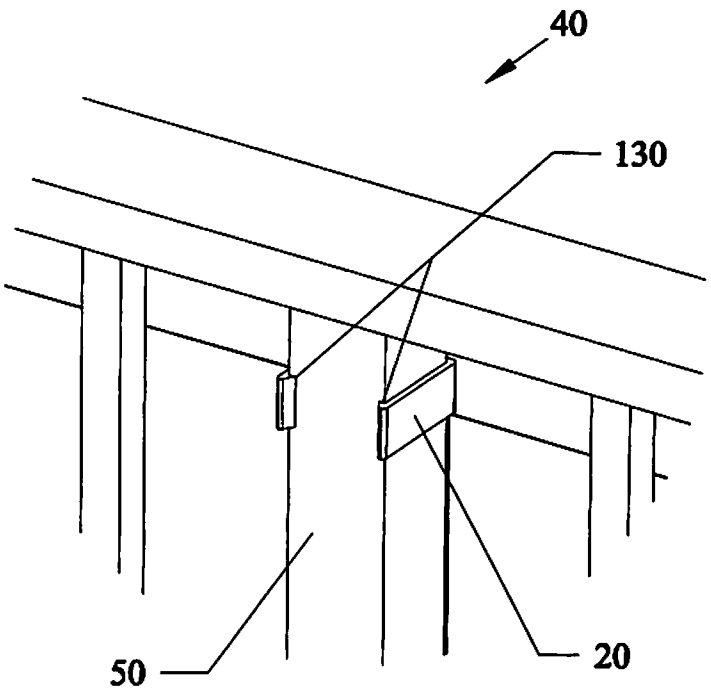
FIG. 8 is a rear perspective view of the installed 2" rail clip of FIG. 5.
Figure 7:
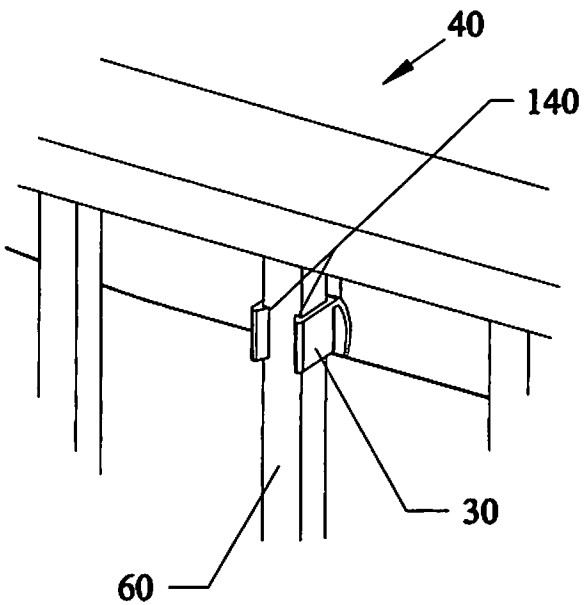
FIG. 7 is a rear perspective view of the 0.8" rail clip of FIG. 4.
Figure 9:
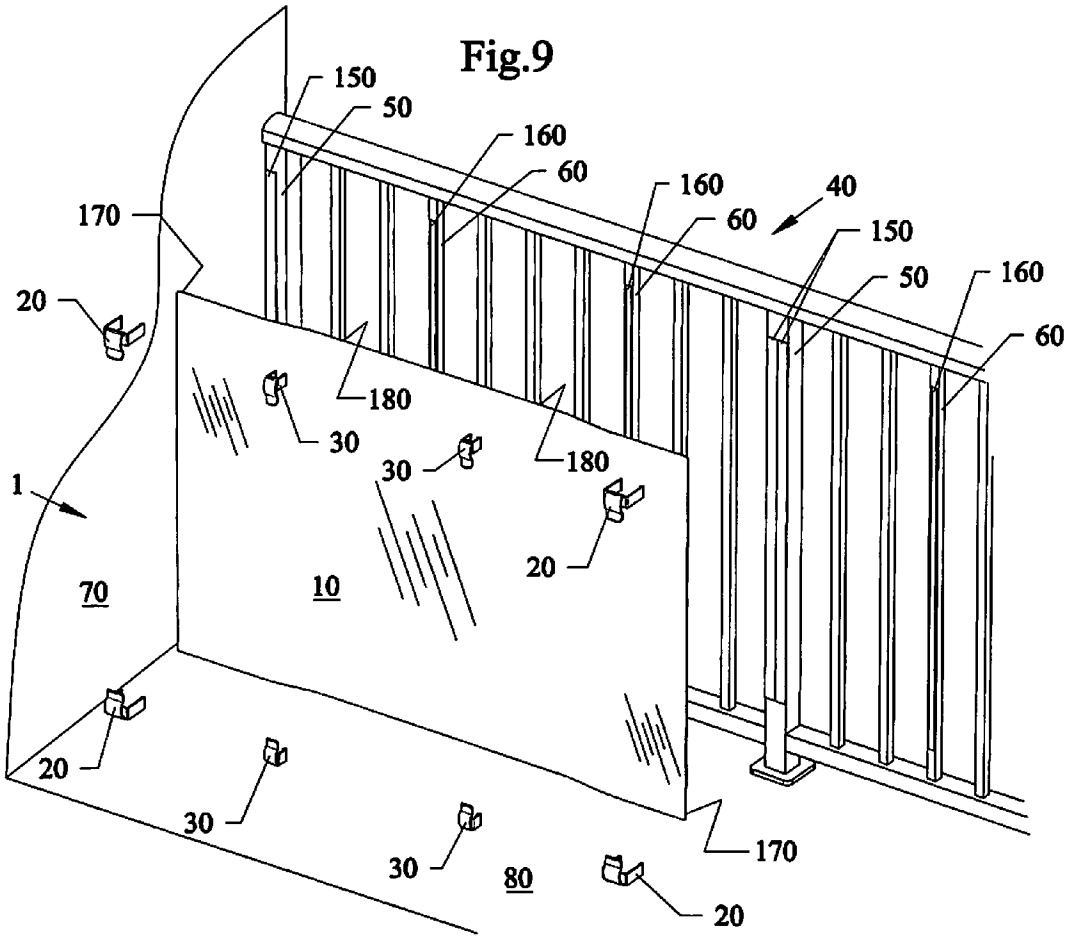
FIG. 9 is an exploded front perspective view of barrier system ready to be installed.

1. barrier system
10. Flexible plastic film barrier panel. Can be transparent or colored opaque.
20. 2" snap on rail clip.
30. 8" snap on rail clip.
40. Existing banister with post supported ends.
45. railing
50. 2" banister post.
60. 8" banister post.
70. Side wall.
80. Deck.
90. Logo, trademark, or other advertising printed onto film barrier.
100. Seam between film barrier panels.
110. 8" clamping finger.
120. 2" clamping finger.
130. 2" clamp retaining snap.
140. 8" clamp retaining snap.
150. 1" wide self-adhesive magnet strip adhered to 2" rail post.
160. ½" wide self-adhesive magnet strip adhered to 0.8" rail post.
170. 1" wide self-adhesive magnet strip adhered to plastic film barrier panel.
180. ½" wide self-adhesive magnet strip adhered to plastic film barrier panel.
190. hook and loop, double sided tape, or zip-tie (VDZ) mounted rail clip.
200. hook and loop or double sided tape.
210. VDZ clamping finger
220. VDZ mounting surface for double sided tape or self-adhesive Velcro.
230. Pass-through hole for zip ties or hook and loop strap.
240. Zip tie.
250. Existing banister with wall supported ends.
260. 1" wide self-adhesive magnet strip adhered to side wall.
270. 1" wide self-adhesive magnet strip adhered to folded panel flange.
280. Flange folded on end of flexible plastic film to interface to side wall.
290. hook and loop strap.
300. 2" strap rail clip.
310. Strap clip retaining snap.
320. Strap clip hinged strap bar.
330. Strap clip snap cutout.
340. Plastic live hinge.
350. Full length clamp with strap rail clips incorporated into each end.
360. Full length clamping bar clamps the full length of the seam between film barriers.
370. Buckle strap.
380. Buckle.
390. Alternate snap on rail clip.
392. front flat face of finger
394. inner convex face of finger
396. side leg with snap end(hook end)
398. side leg with snap end(hook end)
400. Alternate hook and mount clip.
402. head end
403. side slot for strap
404. front flat face of finger
406. inner convex face of finger FIG. 1 is a front view of an existing banister 40 with posts 50/60 that support railing 45 on a deck 80 with side walls 70. FIG. 2 is a front view of the banister 40 of FIG. 11 with the novel barrier system 1 installed. FIG. 3 is an enlarged perspective partial view of the installed barrier system 1 of FIG. 2. FIG. 4 is an enlarged perspective view of an 0.8" rail clip 30 for the installed barrier system 1 of FIG. 2. FIG. 5 is an enlarged perspective view of a 2" rail clip 20 for the installed barrier of FIG. 2. FIG. 6 is a rear perspective view of the installed barrier system 1 of FIG. 3. FIG. 7 is a rear perspective view of the 0.8" rail clip 30 of FIG. 4. FIG. 8 is a rear perspective view of the installed 2" rail clip 20 of FIG. 5. FIG. 9 is an exploded front perspective view of barrier system 1 ready to be installed.

Figure 11:
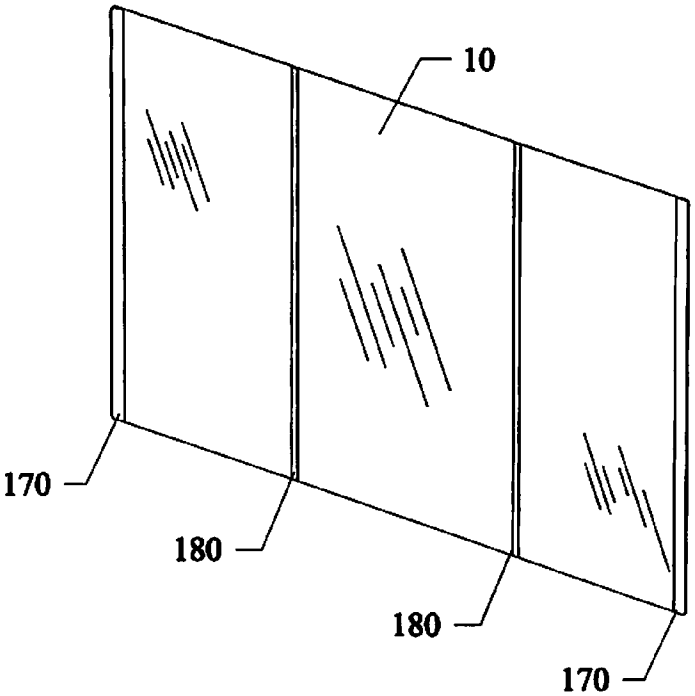
FIG. 11 shows the plastic film barrier of FIG. 10 unrolled and ready to be installed.
Figure 10:
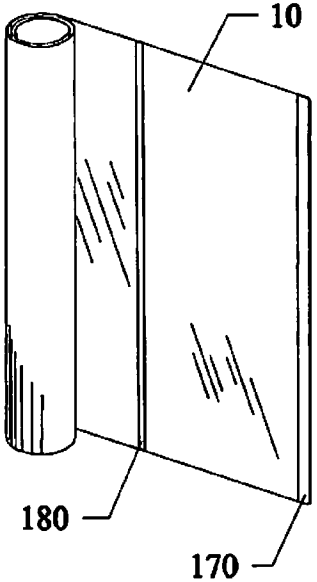
FIG. 10 shows a partially rolled flexible plastic film barrier with magnet strips.

FIG. 10 shows a partially rolled flexible plastic film barrier 10 with magnet strips 170, 180 that can be adhered to the plastic barrier panel 10. FIG. 11 shows the plastic film barrier 10 of FIG. 10 unrolled and ready to be installed.

Figure 13:
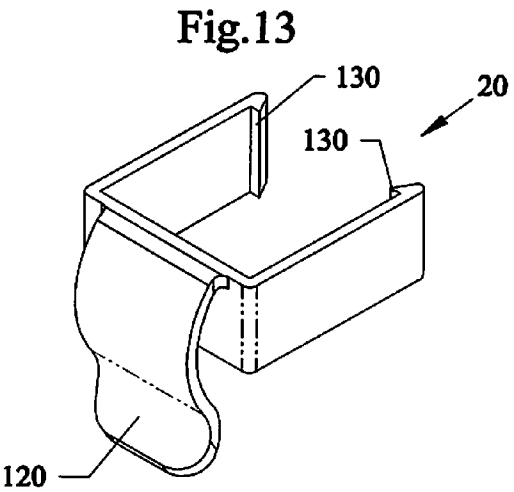
FIG. 13 is a perspective view of the 2" snap on rail clip of FIGS. 5, 8 and 12.
Figure 15:
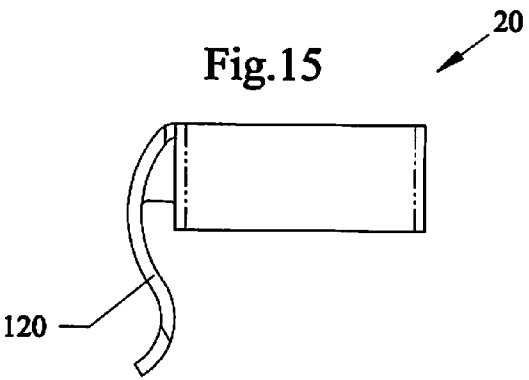
FIG. 15 is a side view of the 2" snap on rail clip of FIGS. 5, 8, and 12-14.
Figure 12:
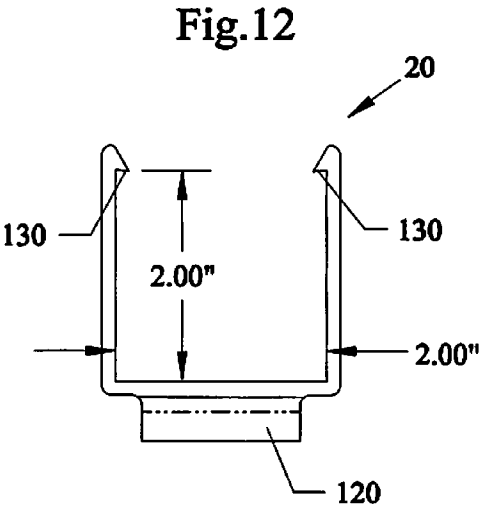
FIG. 12 is a top view of the 2" snap on rail clip of FIGS. 5 and 8.
Figure 14:
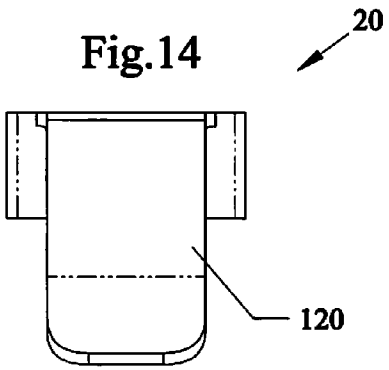
FIG. 14 is a front view of the 2" snap on rail clip of FIGS. 5, 8, 12 and 13.

FIG. 12 is a top view of the 2" snap on rail clip of FIGS. 5 and 8. FIG. 13 is a perspective view of the 2" snap on rail clip 20 of FIGS. 5, 8 and 12. FIG. 14 is a front view of the 2" snap on rail clip 20 of FIGS. 5, 8, 12 and 13. FIG. 15 is a side view of the 2" snap on rail clip 20 of FIGS. 5, 8, and 12-14.

Figure 17:
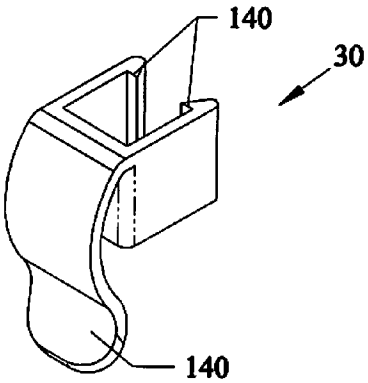
FIG. 17 is a perspective view of the 0.8" snap on rail clip of FIGS. 4, 7 and 16.
Figure 19:
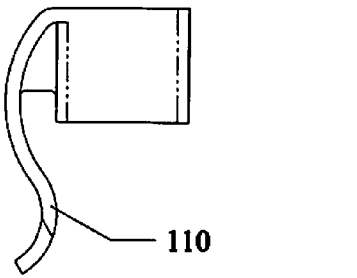
FIG. 19 is a side view of the 0.8" snap on rail clip of FIGS. 4, 7, and 16-18.
Figure 16:
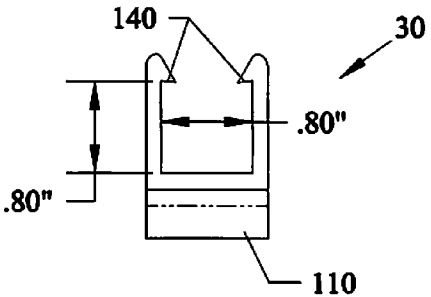
FIG. 16 a top view of the 0.8" snap on rail clip of FIGS. 4, and 7.
Figure 18:
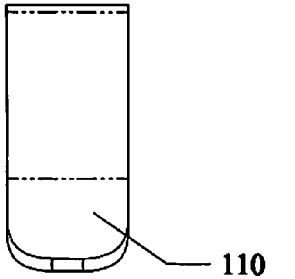
FIG. 18 is a front view of the 0.8" snap on rail clip of FIGS. 4, 7, 16 and 17.

FIG. 16 a top view of the 0.8" snap on rail clip 30 of FIGS. 4, and 7. FIG. 17 is a perspective view of the 0.8" snap on rail clip 30 of FIGS. 4, 7 and 16. FIG. 18 is a front view of the 0.8" snap on rail clip 30 of FIGS. 4, 7, 16 and 17. FIG. 19 is a side view of the 0.8" snap on rail clip 30 of FIGS. 4, 7, and 16-18.

Referring to FIGS. 1-10, the novel barrier system 1 can be installed to cover the inner sides of posts 50 of an existing banister 40. A flexible semi-rigid plastic film barrier panel 10 can be transparent and/or colored opaque. Additionally, the panel 10 can have indicia thereon, such as but not limited to business signage, messages, and the like. The panel can have various thicknesses, such as but not limited to being several mils thick to being approximately 14 to approximately 16 mils thick. The panels can be treated for UV(ultra violet rays) exposure.

The invention can use double sided magnetic tape, such as the double side magnetic tape described in U.S. Patent Application Publication 2001/0055666 to Lee et al., which is incorporated by reference. The invention can use either or both 1" wide double sided self-adhesive magnetic strips 170, and/or ½" wide double sided self-adhesive magnetic strips 180.

Before installation, the installer can cut desired sections of the flexible plastic film barrier panel 10 from a roll.

The 1" wide self-adhesive magnetic strips 170 can be adhered to one side of the flexible plastic film barrier in parallel arrangements with one another, which can be spaced apart to overlay the inner surfaces of the 2" banister posts 50.

Additionally, the ½" wide self-adhesive magnetic strips 180 can be adhered to one side of the flexible plastic film barrier in parallel arrangements with one another, which can be spaced apart to overlay the inner surfaces of the 0.8" banister posts 60.

The 1" wide self-adhesive magnetic strips 150 can be adhered to the inner surfaces of the 2" banister posts 50.

Additionally, the ½" wide self-adhesive magnetic strips 160 can be adhered to the inner surfaces of the 0.8" banister posts 60.

The installer can position to orient the selected sheet of panel 10 so that the exposed magnetic surfaces of strips 170 on panel 10 attach to the exposed magnetic surfaces of strips 150 on posts 50. Similarly, the exposed magnetic surfaces of strips 180 on panel 10 attach to the exposed magnetic surfaces of the strips 160 on posts 60.

Referring to FIGS. 1-19, the mounted sheet panels 10 can be oriented end to end with one another on the posts 50, 60 of the banister 40 so that any vertical seams 100 overlay a mid portion of the larger 2" banister posts 50. Referring to FIGS. 5, 6, 8, 9, 12-15, the 2" snap on rail clips 20 can have side legs each with hooked ends 130 which allow the clips 20 to snap about the posts 50. The installer can orient the clips 20 so that the S shaped 2" clamping fingers 120 on upper and lower placed clips 20 overlays against upper and lower seam edges 100 of the side by side panels 10.

Referring to FIGS. 4, 6, 7, 9, and 16-19, the 0.8" clips 30 can have side legs each with hooked ends 140 which allow the clips 30 to snap about the posts 60. The installer can orient the clips 30 so that the S shaped 0.8" clamping fingers 110 on upper and lower placed clips 30 can hold top and bottom edges of the panel 10 against the posts 60.

Figure 21:
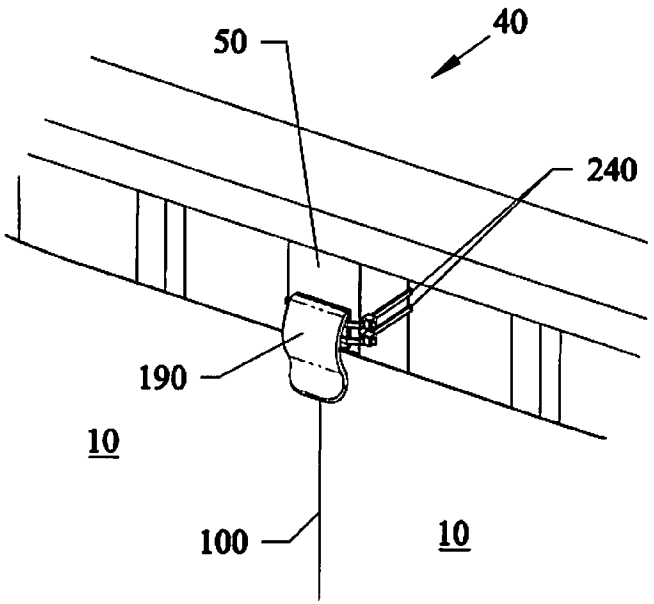
FIG. 21 shows the installed rail clip mounted to the post of the banister of FIG. 20.
Figure 20:
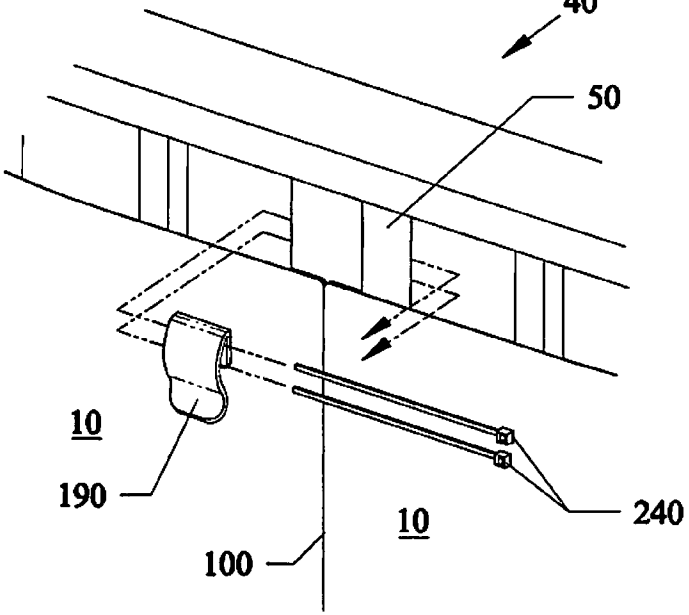

FIG. 20 is an exploded view of another type of rail clip 190 having a generally upside down J shape with the leg portion also having a generally S shape. The hook portion of the J can be attached to a post 50/60 by one or two zip ties 240 that each can be inserted between the hook and S shape portions of the clip and adjustably tightened about the posts 50/60. FIG. 21 shows the installed rail clip 190 mounted to the post 50/60 of the banister 40 of FIG. 20.

Figure 23:
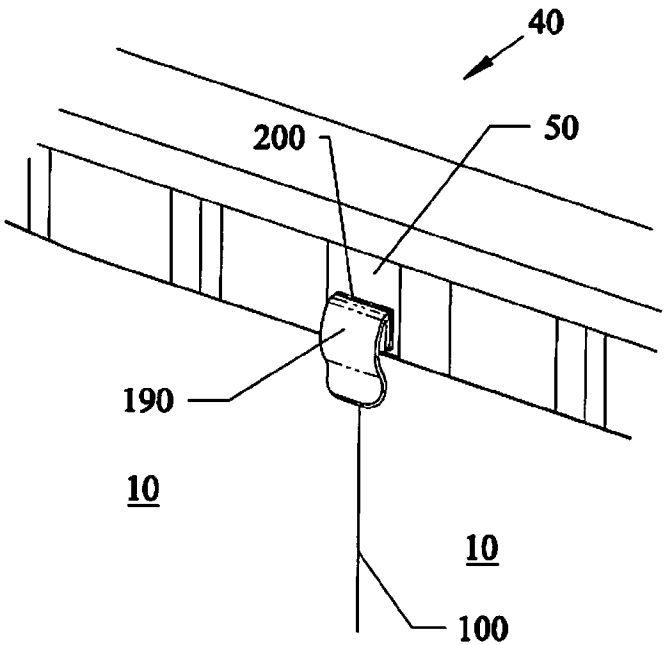
FIG. 23 shows the installed rail clip mounted to the post of the banister of FIG. 22.
Figure 22:
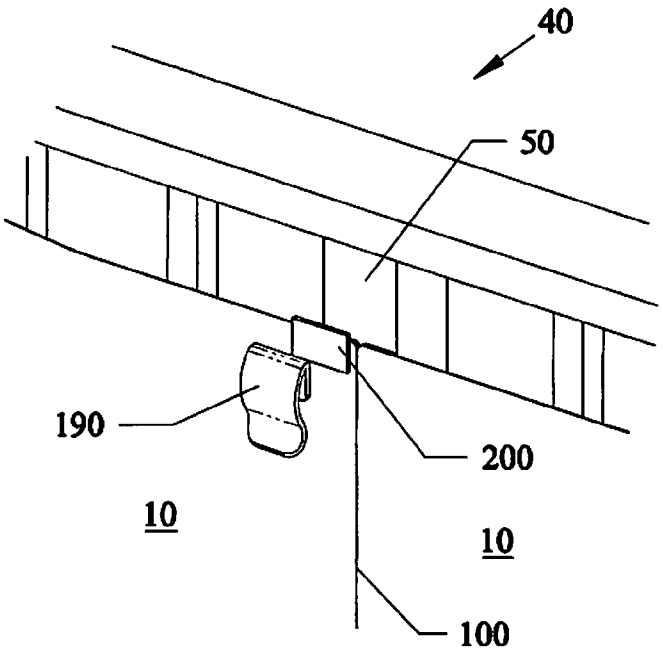
FIG. 22 is an exploded view of a rail clip being installed with hook/loop fasteners or double sided tape to a post of a banister.

FIG. 22 is an exploded view of a rail clip 190 being installed with interlocking hook/loop fasteners 200 and/or double sided tape 200 to a post 50/60 of a banister 40. The installer can attach one side of the hook and loop fastener or double sided tape to the post 50/60, and the mating side of the hook and loop fastener or double sided tape to the outer surface of the hook portion of the clip 190. FIG. 23 shows the installed rail clip 190 mounted to the post 50/60 of the banister 40 of FIG. 22.

Figure 25:
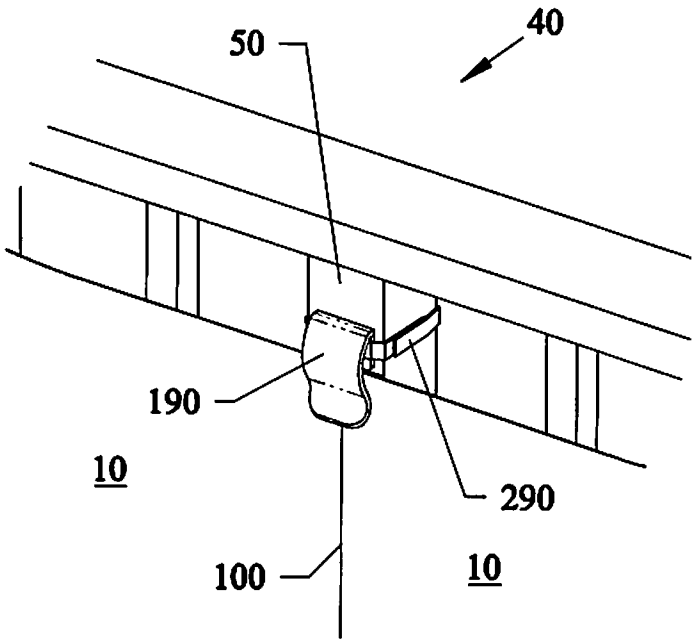
FIG. 25 shows the installed rail clip mounted to the post of the banister of FIG. 24.
Figure 24:
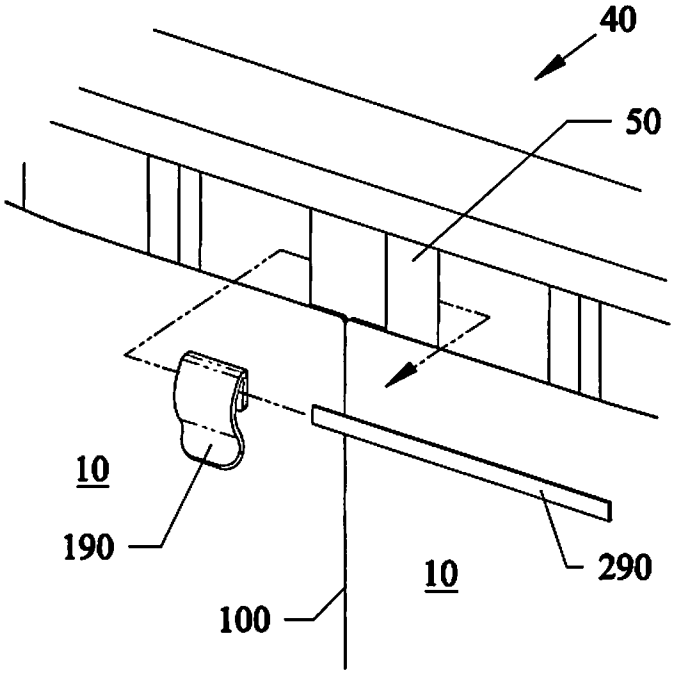
FIG. 24 is an exploded view of a rail clip being installed with strap fasteners to a banister.

FIG. 24 is an exploded view of a rail clip 190 being installed with strap fasteners 290 that each can be inserted between the hook and S shape portions of the clip 190 and adjustably tightened about the posts 50/60. The strap fasteners 290 can be strips with hook and loop fasteners along the surfaces. FIG. 25 shows the installed rail clip 190 mounted to the post of the banister 40 of FIG. 24.

Figure 27:
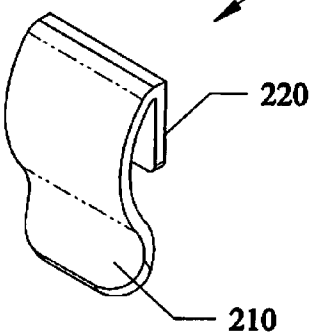
FIG. 27 is a perspective view of the rail clip of FIGS. 20-26.
Figure 29:
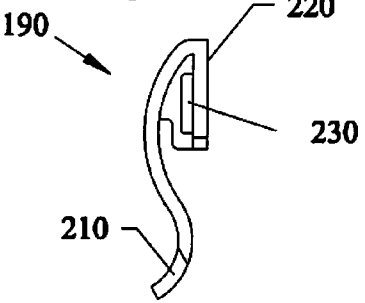
FIG. 29 is a side view of the rail clip of FIGS. 20-28.
Figure 26:
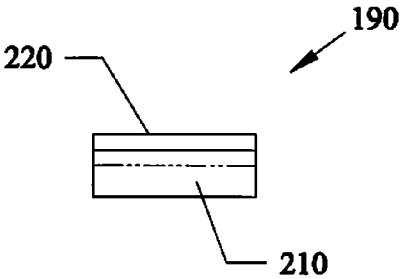
FIG. 26 is a top view of the rail clip used in FIGS. 20-25.
Figure 28:
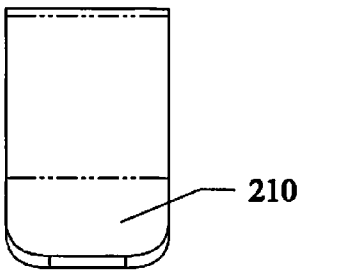
FIG. 28 is a front view of the rail clip of FIGS. 20-27.

FIG. 26 is a top view of the rail clip 190 used in FIGS. 20-25. FIG. 27 is a perspective view of the rail clip 190 of FIGS. 20-26. FIG. 28 is a front view of the rail clip 190 of FIGS. 20-27. FIG. 29 is a side view of the rail clip 190 of FIGS. 20-28.

Referring to FIGS. 26-29, the rail clip 190 can include a S shaped clamping finger 210 with an upper end attached to a hook edge 220 having an exterior mounting surfaces for mounting the double sided tape and/or double sided hook and loop fasteners thereon. The hook edge 220 can also have a pass-through 230 for allowing the zip tie(s) 240 to pass therethrough.

Figures 30, 31, 32:
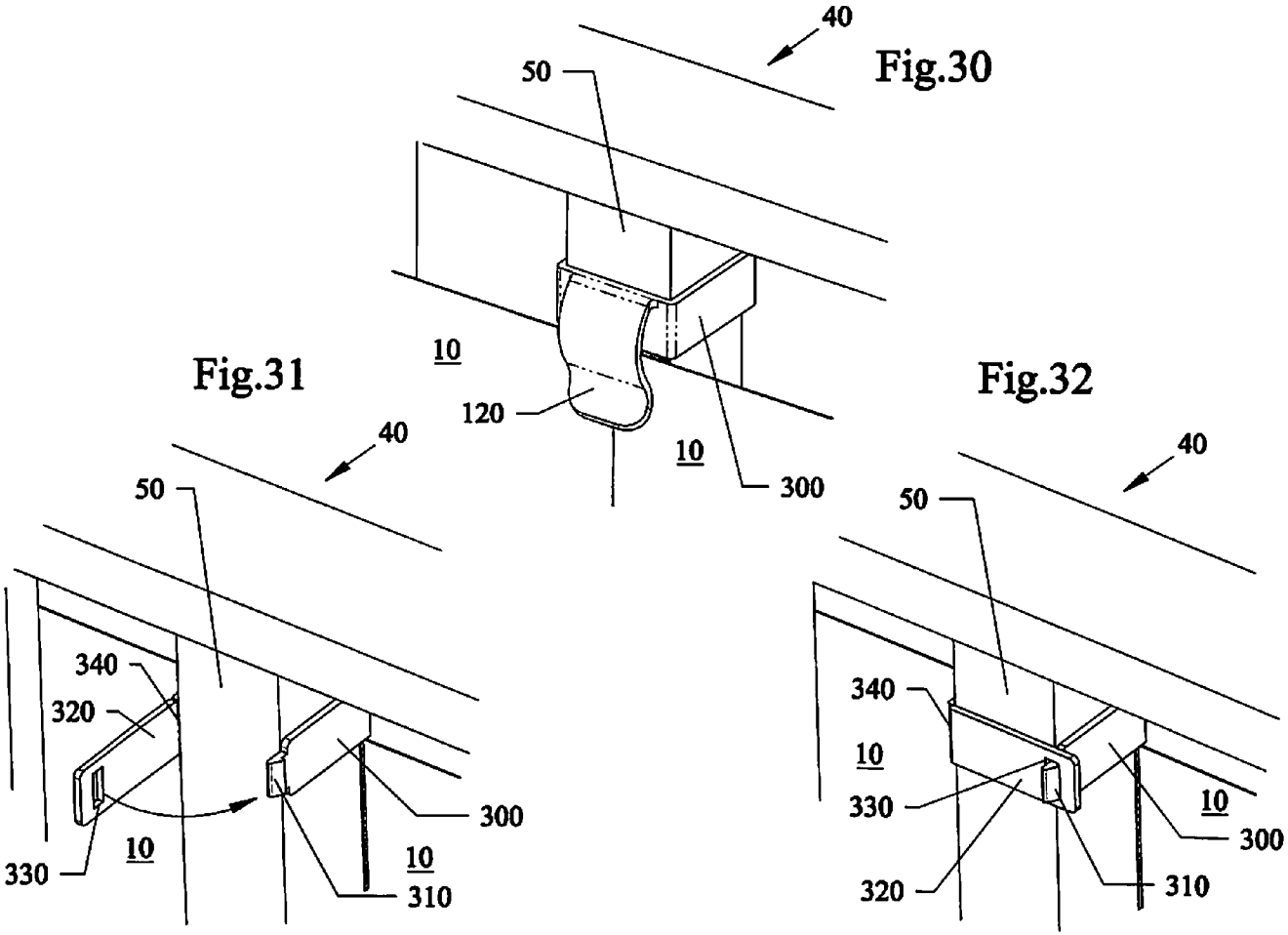
FIG. 30 is a front perspective view of an installed strap rail clip.
FIG. 31 is a rear perspective view of rail clip of FIG. 30 with strap bar unfastened.
FIG. 32 is a rear perspective view of the rail clip of FIGS. 30-31 with strap bar fastened.
Figure 34:
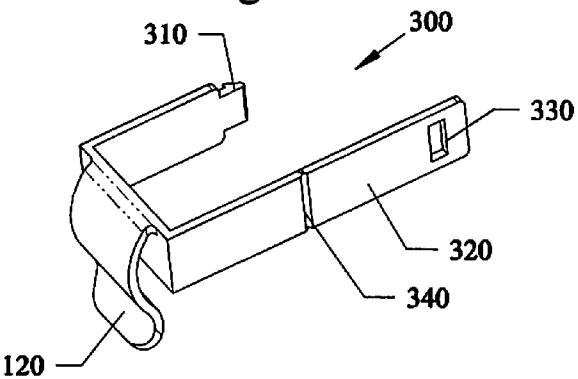
FIG. 34 is a top perspective view of the rail clip of FIGS. 30-33 with strap rail clip unfastened.
Figure 33:
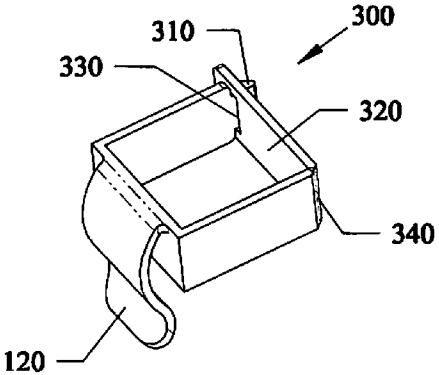
FIG. 33 is a top perspective view of rail clip of FIGS. 30-32 with strap rail clip fastened.
Figure 36:
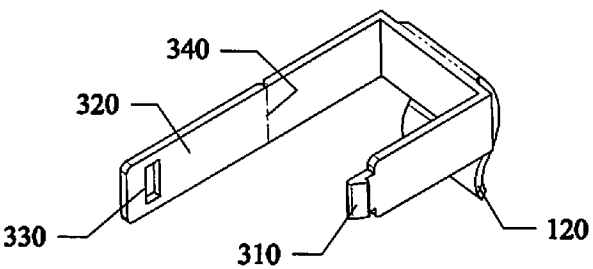
FIG. 36 is a rear perspective view of the rail clip of FIGS. 30-35 with strap rail clip unfastened.
Figure 35:
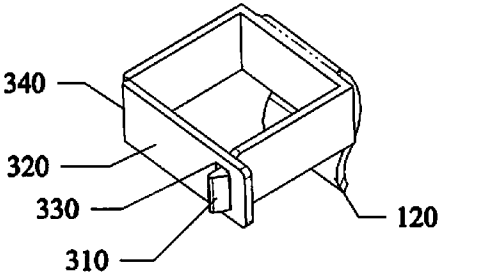
FIG. 35 is a rear perspective view of the rail clip of FIGS. 30-34 with strap rail clip fastened.

FIG. 30 is a front perspective view of another installed strap rail clip 300. FIG. 31 is a rear perspective view of rail clip 300 of FIG. 30 with strap bar 320 attached to hinge 40 in an unfastened position. FIG. 32 is a rear perspective view of the rail clip 300 of FIGS. 30-31 with strap bar 320 fastened. FIG. 33 is a top perspective view of rail clip 300 of FIGS. 30-32 with strap rail clip 300 fastened about a post 50/60. FIG. 34 is a top perspective view of the rail clip 300 of FIGS. 30-33 with strap rail clip bar 320 unfastened. FIG. 35 is a rear perspective view of the rail clip 300 of FIGS. 30-34 with strap rail clip bar 320 fastened. FIG. 36 is a rear perspective view of the rail clip 300 of FIGS. 30-35 with strap rail clip bar 320 unfastened.

Referring to FIGS. 30-36, clip 300 can have a front side with an S shaped clamping finger 120 with rear sides having a strap clip hinged strap bar 320 with an outer end that can bend about the rear of a post 50/60, with a strap clip snap cutout 330 thereon. Opposite strap portion of clip 300 can have an end with a snap clip retaining snap 310 that can snapably attach into the snap cutout 330 locking the clip 300 to the post 50/60.

Figures 37, 38:
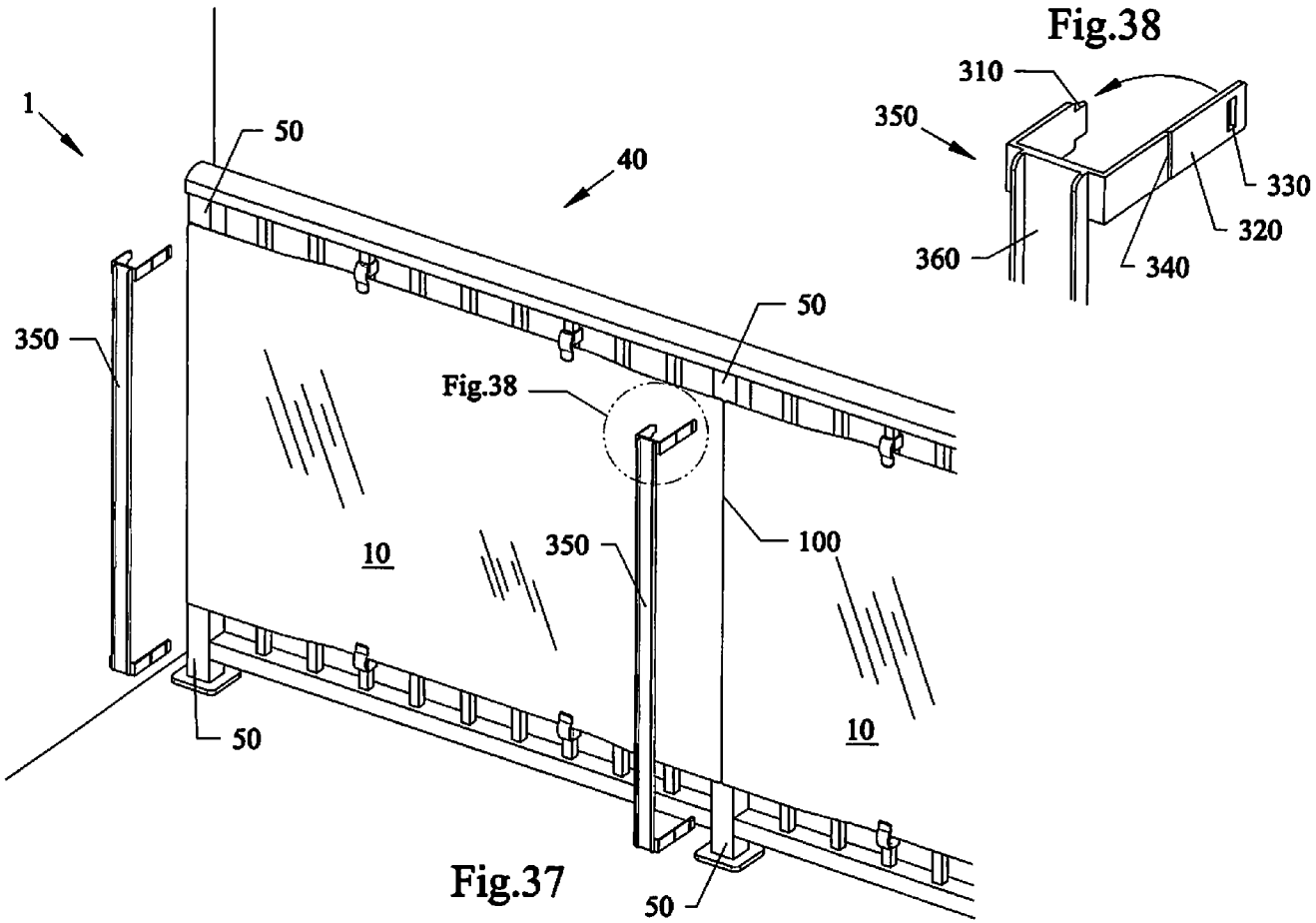
FIG. 37 is a front perspective exploded view of a barrier system being installed with full length post clamp.
FIG. 38 is an enlarged view of a top of a full length post clamp ready for installation.
Figures 39, 40:
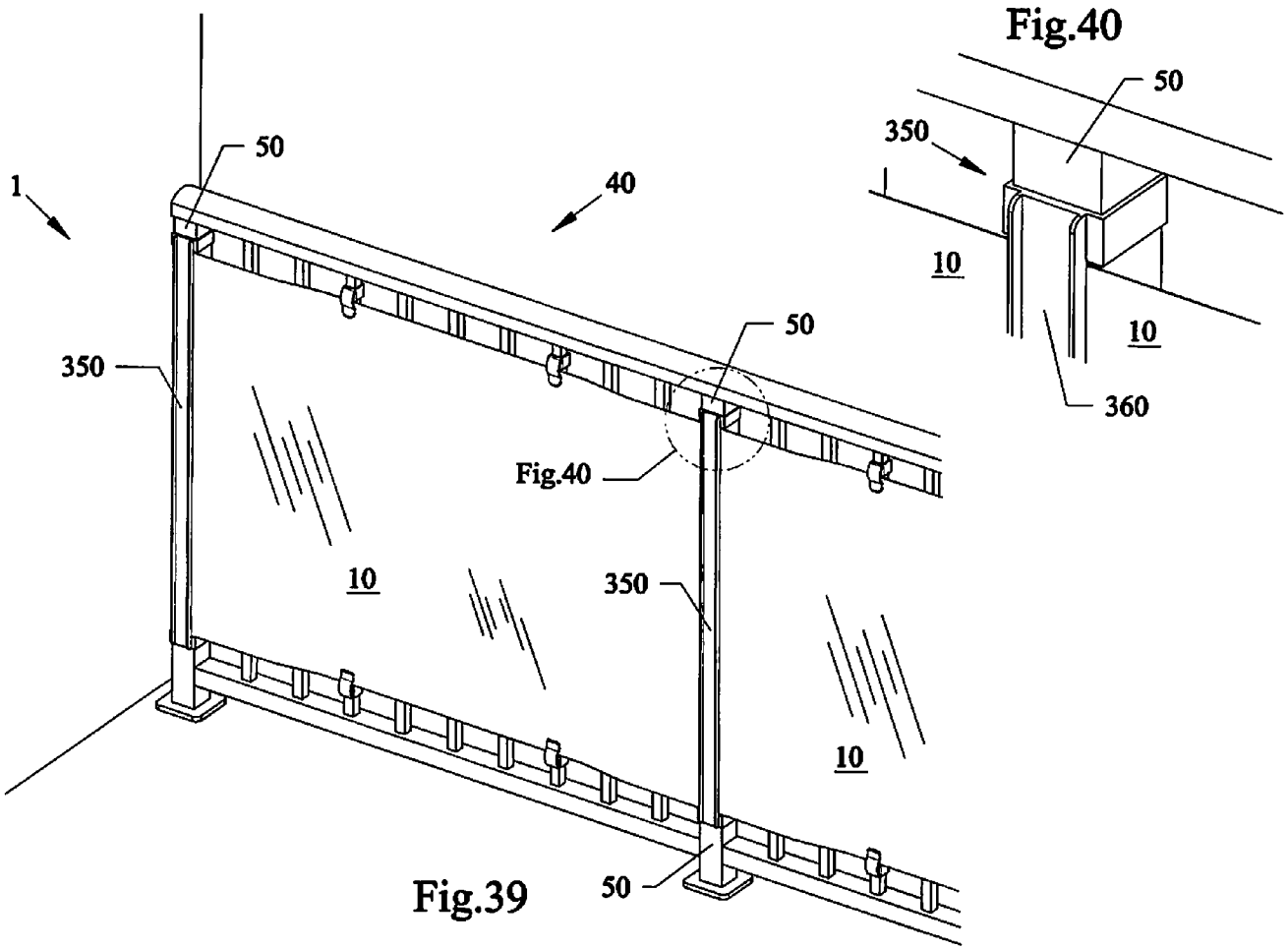
FIG. 39 is a front perspective view of the barrier system of FIG. 37 installed on a banister.
FIG. 40 is an enlarged view of a top of the installed full length post clamp installed.
Figure 43:
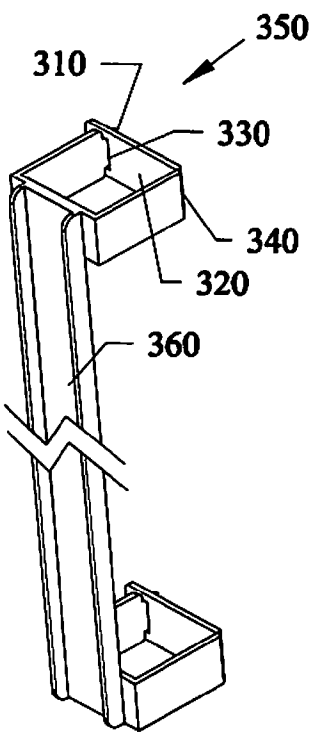
FIG. 43 is a front perspective view of the full length clamp of FIG. 42 with clips closed.
Figure 42:
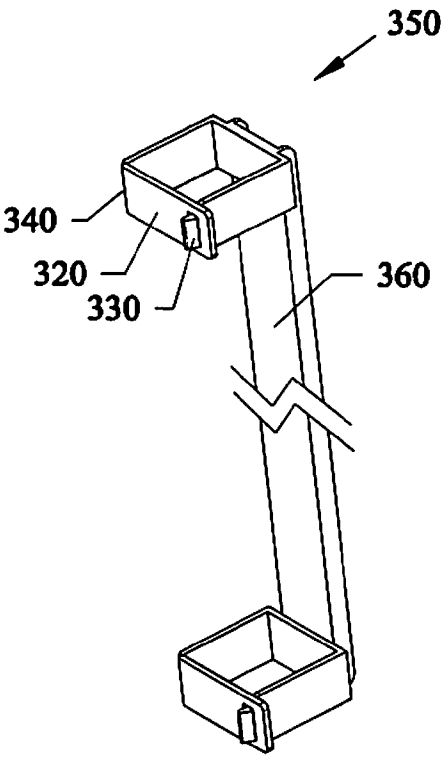
FIG. 42 is a rear perspective view of the full length clamp of FIG. 41 with clips closed.
Figure 41:
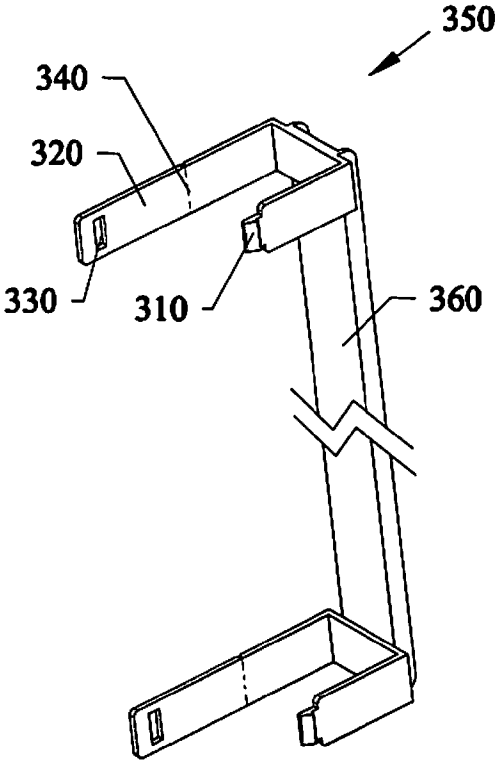
FIG. 41 is a rear perspective view of full length post clamp with open clips.

FIG. 37 is a front perspective exploded view of a barrier system 1 being installed with full length post clamp 350. FIG. 38 is an enlarged view of a top of a full length post clamp 350 ready for installation. FIG. 39 is a front perspective view of the barrier system 1 of FIG. 37 installed on a banister 40. FIG. 40 is an enlarged view of a top of the installed full length post clamp 350 installed on a post 50/60. FIG. 41 is a rear perspective view of full length post clamp 350 with open clips. FIG. 42 is a rear perspective view of the full length clamp 350 of FIG. 41 with clips closed. FIG. 43 is a front perspective view of the full length clamp 350 of FIG. 42 with clips closed.

Referring to FIGS. 37-43, the full length clamp 350 can have a full length clamping bar portion 360 with snap clip retaining snap 310, strap clip hinged strap bar 320, strap clip snap cutout 330 and hinge 340, which function and install as previously described about the posts 50 both above and below the panel 10. The elongated bar portion 360 can also be attached to post 50 using any of the previously described clips. The elongated bar portion 360 allows for the seams 100 between the panels to be more completely covered and protected from peeling off.

Figure 45:
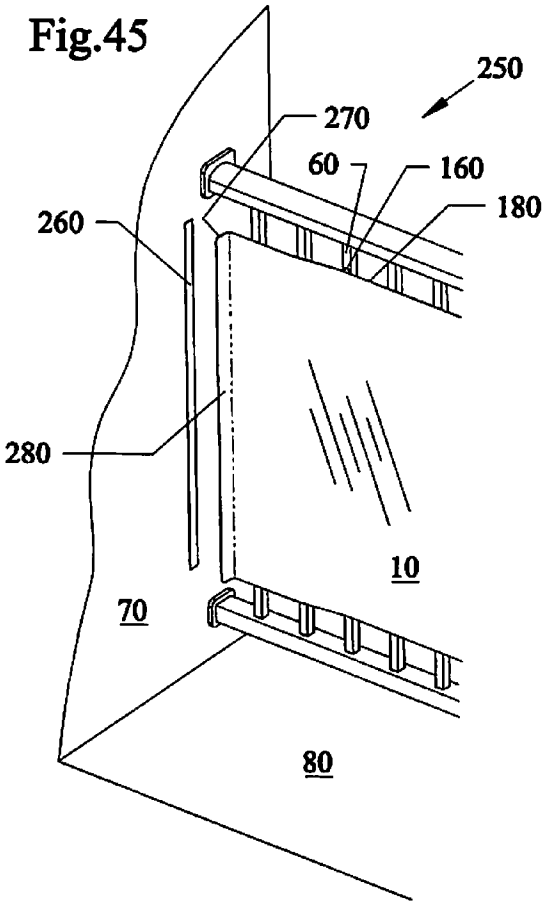
FIG. 45 is an exploded view of the end of the barrier with magnetic strip.
Figure 44:
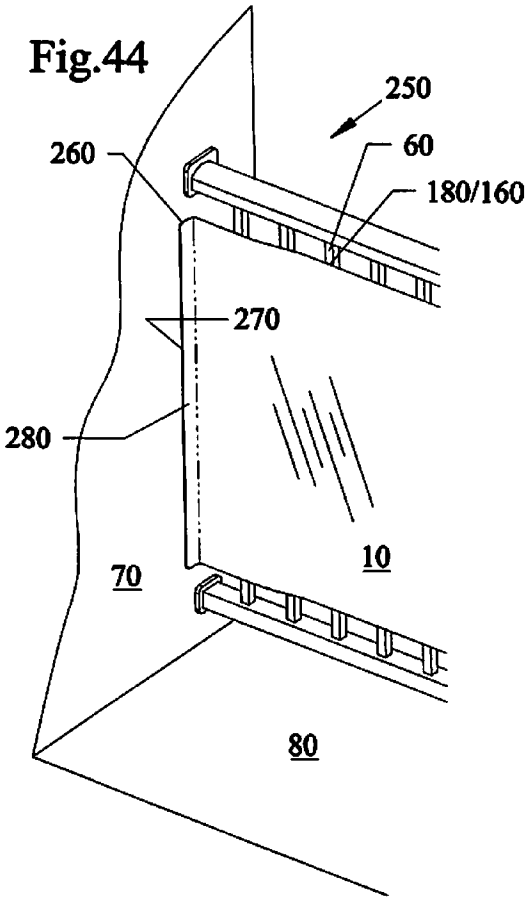
FIG. 44 is a perspective view of the barrier system of the preceding figures installed on an existing banister supported to the wall with magnetic strips.

FIG. 44 is a perspective view of the barrier system 1 of the preceding figures installed on an existing banister 250 whose railings are attached directly to a wall. FIG. 45 is an exploded view of the end of the barrier 10 with magnetic strip 260 thereon. The outer side edge 280 of the panel 10 can be folded to form a flange in order to interface with a fall surface. A 1" wide self-adhesive magnetic strip can be adhered to an outer surface of the flange 280. Another 1" wide self-adhesive magnetic strip 260 can be adhered to the side wall, so that both magnetic strips 260, 270 attach to one another.

Figure 47:
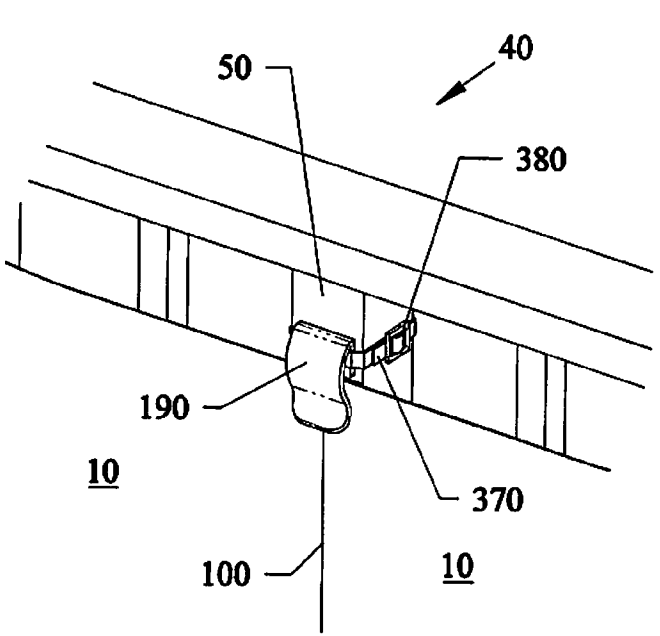
FIG. 47 is a perspective view of the buckle strap clip of FIG. 46 installed to a banister.
Figure 46:
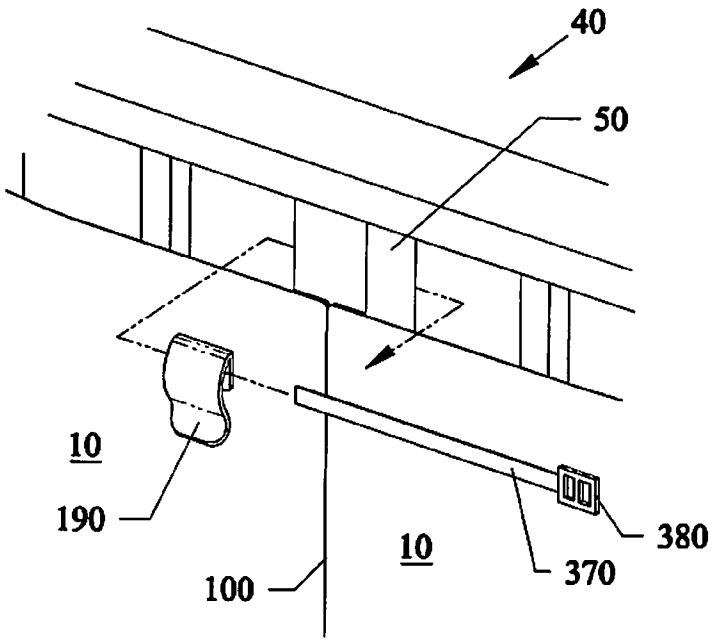
FIG. 46 is an exploded perspective view of a clip with belt buckle strap ready to be used to install a barrier to a post of a banister.

FIG. 46 is an exploded perspective view of a clip 190 previously described with a belt buckle strap 370, 380 ready to be used to install a barrier 10 to a post 50 of a banister 40. FIG. 47 is a perspective view of the buckle strap clip 370, 380 of FIG. 46 installed to a post 50 of banister 40. The buckle portion 380 allows for the clip 190 to be adjustably tightened about the post 50/60.

Figure 51:
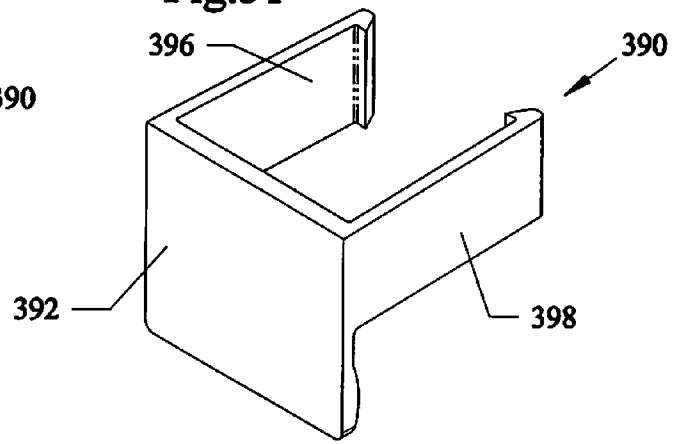
FIG. 51 is a perspective view of the clip of FIG. 48.
Figure 50:
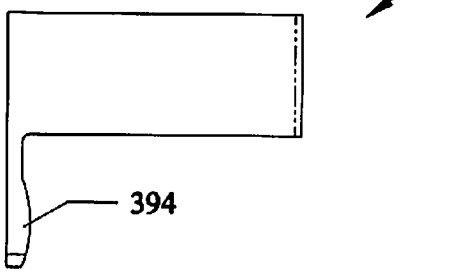
FIG. 50 is a side view of the clip of FIG. 48.
Figure 48:
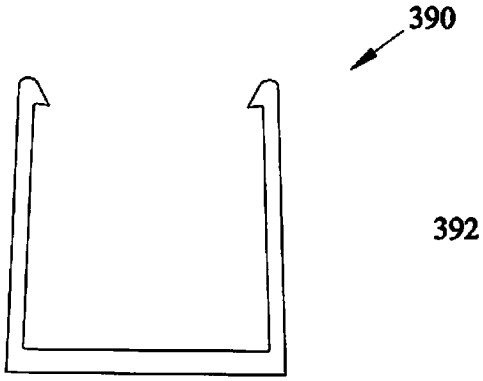
FIG. 48 is a top view of another snap on rail clip having a finger portion with a generally flat exterior face and a convex protruding inner face.
Figure 49:
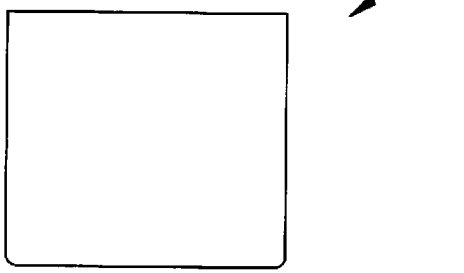
FIG. 49 is a front view of the clip of FIG. 48.

FIG. 48 is a top view of another snap on rail clip 390 having a finger portion 392, 394 with a generally flat exterior face 392 and a convex protruding inner face 394. FIG. 49 is a front view of the clip 390 of FIG. 48. FIG. 50 is a side view of the clip 390 of FIG. 48. FIG. 51 is a perspective view of the clip 390 of FIG. 48. This rail clip 390 can be an alternate snap on rail clip to the rail clip shown and described in relation to FIGS. 12-19.

The snap on rail clip 390 can include a front flat face of finger 392, and an inner convex face of finger 394 with raised portion that presses against an upper or lower edge portion of the installed panel 10 or against a seam 100 in the installed panel(s) 10. Clip 390 can function similarly to the clips 20, 30 by having both a first side leg with snap end(hook end) 396, and a second side leg with snap end(hook end) 398, wherein the legs snap about sides of posts 50, 60 shown in the previous figures.

Figure 55:
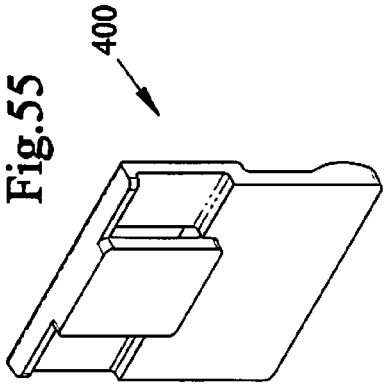
FIG. 55 is a perspective view of the clip of FIG. 52.
Figure 56:
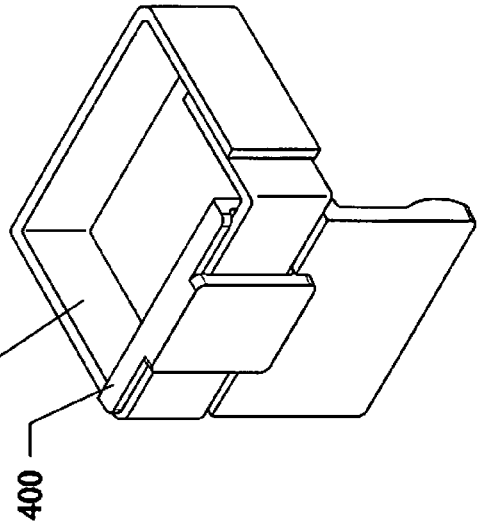
FIG. 56 is a perspective view of the clip of FIG. 55 with a hook and loop strap installed.
Figure 54:
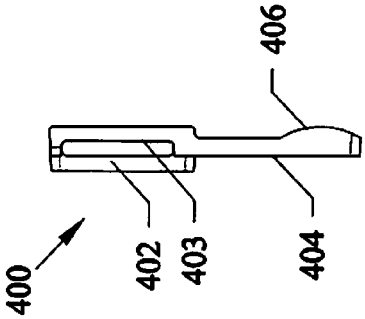
FIG. 54 is a side view of the clip of FIG. 52.
Figure 52:
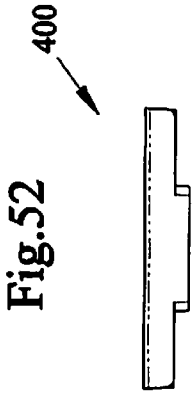
FIG. 52 is a top view of another strap rail clip.
Figure 53:
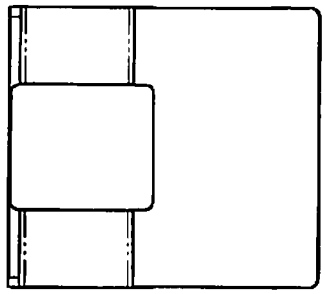
FIG. 53 is a front view of the clip of FIG. 52.

FIG. 52 is a top view of another strap rail clip 400. FIG. 53 is a front view of the clip 400 of FIG. 52. FIG. 54 is a side view of the clip 400 of FIG. 52. FIG. 55 is a perspective view of the clip 400 of FIG. 52. FIG. 56 is a perspective view of the clip 400 of FIG. 55 with a hook and loop strap 290 installed.

This alternate clip 400 includes a head end 402 with side slot 403 that allows for a strap 290, such as a hook and loop fastener strap to be inserted therethrough. Clip 400 includes a finger portion with a front flat face 404 and an inner facing edge convex curved edge 406 that can press against an exterior portion of a panel 10 or a seam 100 between panel(s) 10. The clip 400 attached to posts 40/60 similar to the clip 190 shown and described in reference to FIGS. 24-29.

The clips can be made from plastic, metal, combinations thereof, and the like.

Although dimensions for the post clips and tape strips are referenced above, the invention clip sizes and tape strips can vary depending upon the different diameter posts.

Although the double sided tape described above, uses magnets, the invention include double sided tape without magnets. Additionally, the double sided tape can include hook and loop fasteners, such as mushroom headed fasteners.

While the invention is described as a barrier for protecting pets and children, the barrier invention can be used for storm protection to prevent air, rain, snow, and the like, from passing through the openings between posts underneath railings.

The novel barrier can be easily disassembled and put away when not being used. The invention can be installed by professionals, consumers, and/or be packaged in kit forms with the components in a package.

While the invention is described for use with balconies, banisters and stair railings having posts, the invention can be used to cover openings between vertical posts in other applications, such as but not limited to cribs, bassinets, and the like. Still furthermore, the protective barrier invention can be used to cover other openings, such as but not limited to doorways, windows, entrances to stairs, and any other type of opening.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A barrier system for banisters, balconies and stair railings, comprising:

a flexible parcel having a generally rectangular configuration:

a plurality of elongated strips with exterior surfaces having adhesive thereon; and a plurality of post clips, wherein the panel is adaptable to be attached to posts which support railings on the banisters, balconies and stair railings, by positioning the elongated strips between portions of the panel and side surface portions of the post, and by clamping upper and lower edge portions of the panel to side portions of the posts by the post clips, and wherein each of the post clips include:

a clamp member having a configuration along a horizontal plane for clamping about the side portions of the posts; and and a finger portion which extends perpendicular from a horizontal plane of the clamp member so that the finger portion presses against an exterior surface portion of the panel.

2. The barrier system of claim 1, wherein each of the elongated strips includes:

a pair of strips sandwiched together having exterior surfaces with peel and stick tape, and interior facing magnetic surfaces.

3. The barrier system of claim 1, wherein the clamp member of each post clip includes:

two bendable flanges having outer ends which snap about the side portions of the post.

4. The barrier system of claim 3, wherein the bendable flanges have a spacing therebetween of approximately 0.8 inches.

5. The barrier system of claim 3, wherein the bendable flanges have a spacing therebetween of approximately 2 inches.

6. The barrier system of claim 3, wherein each of the bendable flanges includes:

hook ends.

7. The barrier system of claim 1, wherein the finger portion is selected from one of an S shape, and a finger having a flat exterior face and an inner convex face.

8. The barrier system of claim 1, wherein the clamp member includes:

a zip tie.

9. The barrier system of claim 1, wherein the clamp member includes:

double sided tape.

10. The barrier system of claim 1, wherein the clamp member includes:

a strip having hook and loop fasteners.

11. The barrier system of claim 1, wherein the clamp member includes:

a rail clip strap with retaining strap on one end and a second end with a strap clip snap cutout.

12. The barrier system of claim 1, wherein each clamp member includes a pair of clamp members, and the finger is an elongated member having ends attached to each clamp member.

13. The barrier system of claim 12, wherein each of the clamp member pairs includes:

a rail clip strap with retaining strap on one end and a second end with a strap clip snap cutout.

14. The barrier system of claim 1, wherein the clamp member includes:

a belt with buckle end for clamping about a perimeter surface of the post.

15. The barrier system of claim 1, wherein the plastic panel is a translucent plastic panel.

* * * * *